US006308843B1

(12) United States Patent
De Boer

(10) Patent No.: US 6,308,843 B1
(45) Date of Patent: Oct. 30, 2001

(54) FOLDABLE CLOTHES-LINES

(76) Inventor: Barry R. De Boer, 6 Hovea Place, Sydney, Grays Point, NSW, 2232 (AU)

( * ) Notice: Subject to any disclaimer, the term of this patent is extended or adjusted under 35 U.S.C. 154(b) by 0 days.

(21) Appl. No.: 09/300,547

(22) Filed: Apr. 27, 1999

(30) Foreign Application Priority Data

Apr. 30, 1998 (AU) ..... PP3283

(51) Int. Cl.[7] ..... D06F 53/00
(52) U.S. Cl. ..... 211/119.01; 211/104; 211/96
(58) Field of Search ..... 211/119.01–119.09, 211/119.1, 119.12, 96, 104, 168; 248/301, 353, 218.4, 219.2, 289.11, 240

(56) References Cited

U.S. PATENT DOCUMENTS

| | | | | |
|---|---|---|---|---|
| 704,026 | * | 7/1902 | Gordon et al. | 211/119.07 |
| 1,127,127 | * | 2/1915 | Walsh | 211/119.07 |
| 1,127,693 | * | 2/1915 | Stasaitis | 211/119.07 |
| 1,137,395 | * | 4/1915 | Gamble | 211/119.07 |
| 1,149,894 | * | 8/1915 | Boria | 211/119.07 |
| 1,200,773 | * | 10/1916 | Steensgaard | 211/119.07 |
| 1,241,892 | * | 10/1917 | Zeller | 211/119.07 |
| 1,462,241 | * | 7/1923 | Munford | 211/119.07 |
| 1,490,485 | * | 4/1924 | Roziger | 211/119.07 |
| 1,616,314 | * | 2/1927 | Festenburg et al. | 211/119.07 |
| 1,637,174 | * | 7/1927 | Carland | 211/119.07 |
| 1,740,899 | * | 12/1929 | Mooney | 211/119.1 |
| 2,164,437 | * | 7/1939 | Wilber | 211/119.07 |
| 2,302,028 | * | 11/1942 | Healy | 211/119.07 |
| 2,478,450 | * | 8/1949 | Bahls | 211/119.07 |
| 3,627,142 | * | 12/1971 | Steiner | 211/119.1 |
| 5,078,276 | * | 1/1992 | Rogge et al. | 211/96 X |

* cited by examiner

*Primary Examiner*—Daniel P. Stodola
*Assistant Examiner*—Erica B. Harris
(74) *Attorney, Agent, or Firm*—Jacobson & Johnson

(57) ABSTRACT

A foldable clothes-line having a pair of arms together with mounting brackets for fixing to supports. The arms comprise base sections which in use of the clothes-line engage in the brackets and line carriage sections disposed at right angles to the base sections. The arms are pivotal in the brackets in a substantially horizontal plane between a first position at which the line carriage sections extend outwardly to deploy the clothes-line for service and a second folded position whereby the line carriage sections are located closely adjacent to the supports in a space saving configuration. The mounting brackets have a retaining mechanism to releasably hold the line carriage sections in the outwardly extended position.

5 Claims, 2 Drawing Sheets

FOLDABLE CLOTHES-LINES

FIELD OF THE INVENTION

This invention relates to a drying apparatus. More particularly although not exclusively it discloses an improved foldable and removable clothes-line for confined spaces.

BACKGROUND OF THE INVENTION

Due to the requirements of high density development most urban and even suburban dwellings are being constructed with very little free space surrounding them. Available space for clothes-lines or the like is now often restricted to merely a narrow passage along the side of a house, a small courtyard or a balcony which all have to be available for other purpose. While there are clothe-lines known to be foldable when not in service to minimize space, these tend to be expensive and/or are complicated to use and do not have the ability to be completely removed.

SUMMARY OF THE INVENTION

It is therefore an object of this invention to ameliorate the aformentioned disadvantages and accordingly a foldable clothes-line is disclosed having one or more arms together with mounting means adapted for fixing to a support surface, said arms comprising base sections which in use of the clothes-line engage in said mounting means and line carriage sections disposed at an angle to said base sections, said arms being pivotal in said mounting means in a substantially horizontal plane between a first position at which said line carriage sections extend outwardly from said support surface to deploy said clothes-line for service and second folded position wherein said line carriage sections are located substantially parallel to said support surface in a space saving flat configuration and said mounting means including retaining means to releasably hold said line carriage sections in said outwardly extended position.

Preferably said retaining means employ the weight of the arms to hold the line carriage sections in the ourwardly extended position.

BRIEF DESCRIPTION OF THE DRAWINGS

The currently preferred embodiment of this invention will now be described with reference to the attached drawings in which.

DETAILED DESCRIPTION OF THE PREFERRED EMBODIMENT

Figure 1:
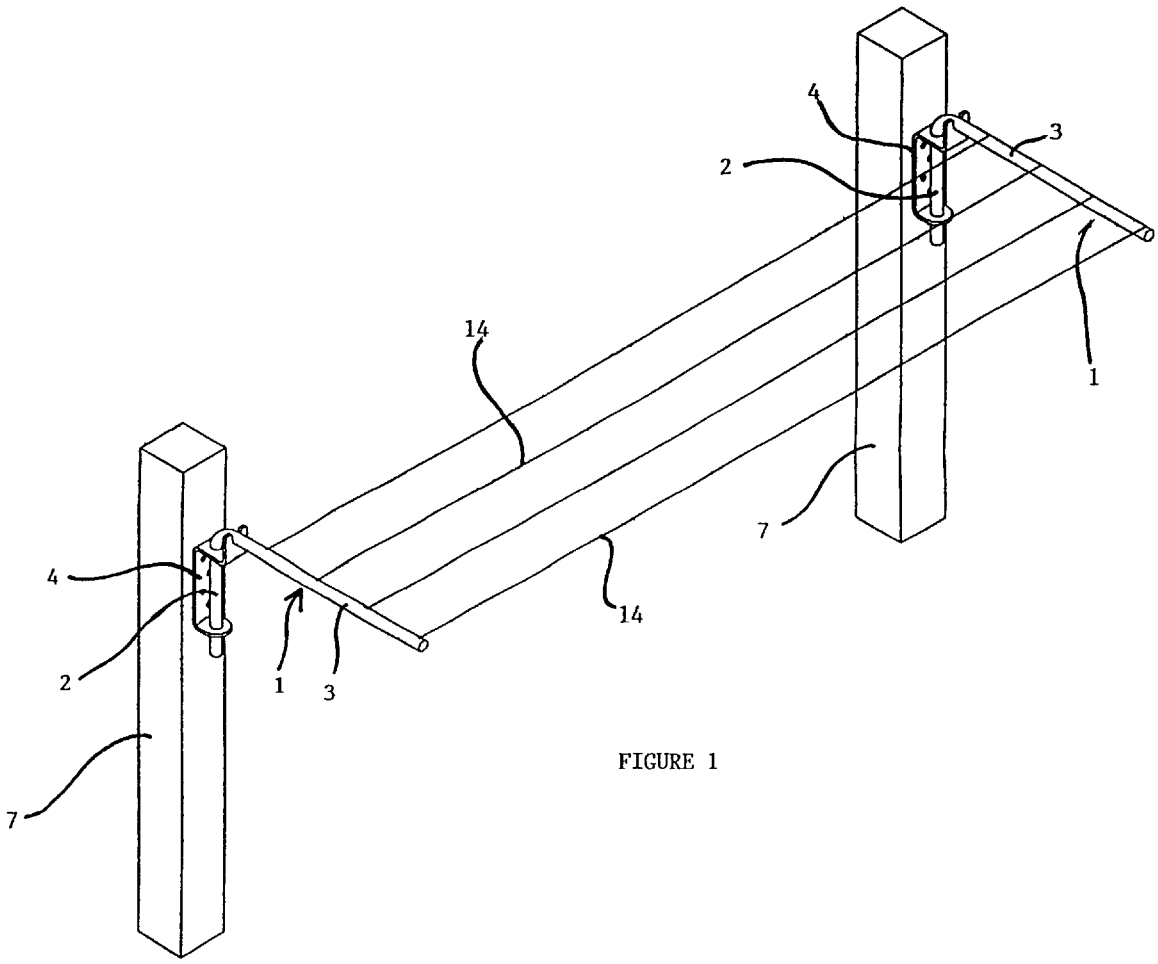
FIG. 1 is a schematic view in perspective of a clothes-line according to this concept in the outwardly extended position.
Figure 2:
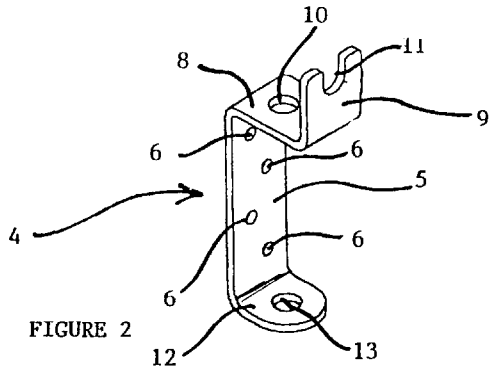
FIG. 2 is a detailed view of one of the mounting brackets shown in FIG. 1.

Referring first to FIGS. 1 and 2 the clothes-line may comprise a pair of arms 1 with base sections 2 and line carriage sections 3 which are disposed at right angles to the base sections. With this particular embodiment the arms are made from 16 gauge round steel tube although other materials may also be used within the scope of the invention.

The mounting brackets 4 for the arms as best shown in FIG. 2 are preferably of 6 mm pressed steel plate. They each comprise a central vertical section 5 with apertures 6 to receive mechanical fasteners such as screws, bolts or the like for fixing to a support such as a post 7 as shown, or a wall or other suitable structure. The upper portions of the bracket extend out horizontally at 8 and then vertically via a flange 9. The horizontal section 8 includes a hole 10 of suitable diameter to receive the base section 2 of an arm and the uppermost section 9 is formed with a recess 11. The lower portion 12 of the bracket also extends out horizontally and includes a hole 13 which is of similar diameter to 10 and is vertically aligned with it. In use of the clothes-line in its outwardly extended position as shown in FIG. 1 the base sections 2 are fitted through the aligned holes 10 and 13 of the brackets which in this case are secured to the spaced apart posts 7. The line carriage sections 3 of the arms are also seated within the recesses 11. With this embodiment the weight of the arms locks them in this extended position so that a plurality of line 14 are drawn out between the line carriage sections.

Figure 3:
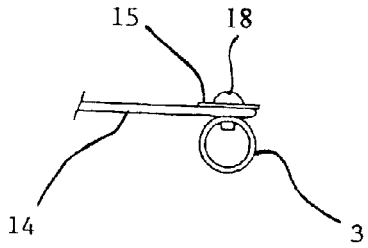
FIG. 3 is an end view of a portion of one of the clothes-line arms showing the preferred method of anchoring the lines.

The currently preferred method of securing the lines 14 to the arms 1 is by means of clamp plates 15 and screws 18 as shown in FIG. 3. The line material 14 is wrapped around the screw shank below the clamp plate 15 and then the screw is tightened as required to anchor the line against the weight of clothing hung on it.

Figure 4:
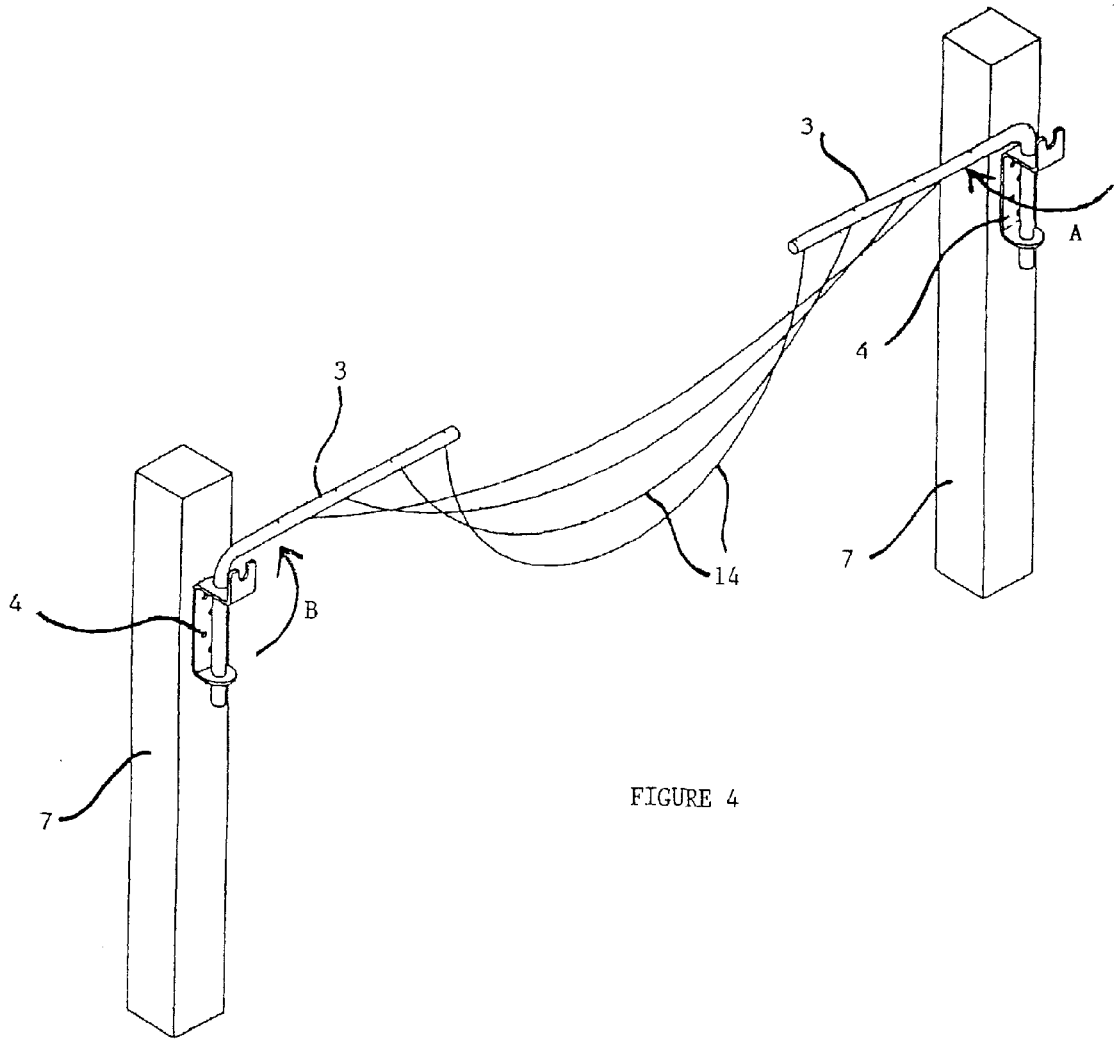
FIG. 4 is a perspective view of the clothes-line of FIG. 1 in the folded position.

After use the arms 1 can be lifted clear of the recesses 11 and then pivoted inwardly as shown in FIG. 4 by arrows A and B against the posts 7 or other support structure. In such folded configuration the arms occupy only a minimum of space and therefore allow alternative use of a patio, courtyard or balcony for other activities. Preferably the arms may also be lifted completely out of the bracket holes 10, 13 and stored until required again.

Figure 5:
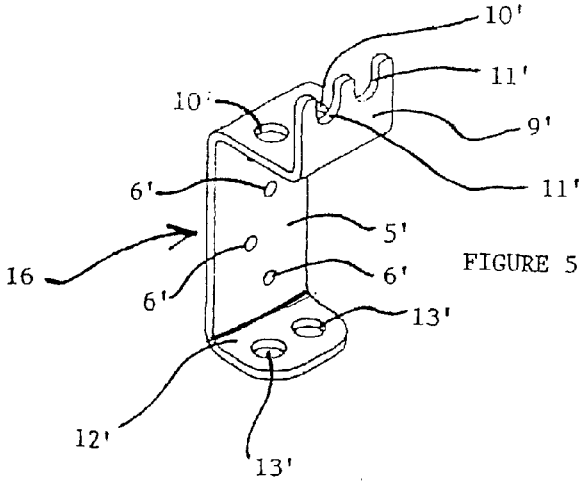
FIG. 5 shows a second form of mounting bracket.

To increase the capacity of the clothes-line repeating pairs of arms may be mounted side by side. A modified form of intermediate mounting bracket for such arrangement is shown in FIG. 5. This bracket 16 operates in a similar manner to that described earlier and the main components which correspond in function to those shown in FIG. 2 are indicated by the same number but with the addition of an accent (′). In this case there are pairs of vertically aligned holes 10′, 13′ and adjacent recesses 11′. When in use a pair of arms are located in these holes and recesses so as to extend out parallel from the support surface. To fold the clothes-line the arms are lifted as described earlier and pivoted inwardly in opposite directions.

It will thus be appreciated that this invention at least in the form of the embodiment described comprises a novel and useful improvement to clothes-lines. Clearly however the example disclosed is only the currently preferred form of this invention and a wide variety of modifications may be made which would be apparent to a person skilled in the art. For example while it is currently preferred to form the arms from bent steel tube and the brackets from pressed steel plate other materials of fabrication may be used. Also, for the purposes of this specification expressions such as "vertically", "horizontal", "upper" and "lower" etc. refer to the device in a position of use as illustrated and are not to be read as necessarily limiting.

What is claimed is:

1. A foldable clothes-line having at least two arms together with mounting means for fixing said clothes-line to a support surface, said arms comprising base sections which in use of the clothes-line engage in said mounting means and line carriage sections disposed at an angle to said base sections, said arms being pivotal in said mounting means in a substantially horizontal plane between a first position at which said line carriage sections will extend outwardly from said support surface whereby said clothes-line is deployed for service and a second folded position whereby said line carriage sections will be folded inwardly towards each other to locate closely adjacent to and substantially parallel to said support surface in a space saving configuration, at least one screw and at least one clamp plate, said screw and said clamp plate securing a line to one of said arms, said mounting means comprising a respective mounting bracket for each of said arms, said respective mounting bracket having a central vertical section with apertures to receive mechanical fasteners and upper and lower horizontal portions with vertically aligned holes to receive one of said base sections, said upper portion including a vertical flange with a recess horizontally spaced outwardly from said vertically aligned holes, said recess being U shaped so that one of said line carriage sections is weighted down into said recess and locked against rotation and thereby held to extend outwardly when the clothes-line is deployed for service and said one of said base sections being removable from said respective mounting bracket by lifting out of said vertically aligned holes and lines of said clothes-line being secured to said line carriage sections by wrapping portions of said lines around screws below clamp plates and said screws being tightened into said line carriage sections to anchor said lines against a weight of clothing hung thereon.

2. The foldable clothes-line as claimed in claim 1 wherein the base sections of said at least two arms are disposed substantially at right angles to said line carriage sections.

3. The foldable clothes-line as claimed in claim 2 comprising a pair of arms pivotally mounted in said mounting means.

4. The foldable clothes-line as claimed in claim 3 wherein said mounting means includes an intermediate mounting bracket having pairs of vertically aligned holes and adjacent recesses.

5. The foldable clothes-line as claimed in claim 4 wherein said arms are removable from said mounting means.

* * * * *